US012352065B2

(12) United States Patent
Flores

(10) Patent No.: US 12,352,065 B2
(45) Date of Patent: Jul. 8, 2025

(54) BORDER WALLS AND RELATED SYSTEMS AND METHODS

(71) Applicant: Tricon Precast, Ltd., Houston, TX (US)

(72) Inventor: Gilbert M. Flores, Montgomery, TX (US)

(73) Assignee: Tricon Precast, Ltd., Houston, TX (US)

( * ) Notice: Subject to any disclaimer, the term of this patent is extended or adjusted under 35 U.S.C. 154(b) by 0 days.

(21) Appl. No.: 18/886,979

(22) Filed: Sep. 16, 2024

(65) Prior Publication Data

US 2025/0012110 A1 Jan. 9, 2025

Related U.S. Application Data

(63) Continuation of application No. 16/747,466, filed on Jan. 20, 2020, now Pat. No. 12,116,798.

(51) Int. Cl.
*E04H 17/14* (2006.01)
*E04H 17/22* (2006.01)

(52) U.S. Cl.
CPC ..... *E04H 17/1417* (2013.01); *E04H 17/22* (2013.01); *E04H 17/1404* (2013.01)

(58) Field of Classification Search
CPC . E04H 17/14; E04H 17/1439; E04H 17/1426; E04H 17/16; E04H 17/22; E04H 17/1404; E04H 12/22; E04F 11/181; E04F 11/1812; E04F 11/1842; E04F 11/1846
See application file for complete search history.

(56) References Cited

U.S. PATENT DOCUMENTS

| | | | |
|---|---|---|---|
| 2,564,866 | A | 8/1951 | Tassel |
| 2,659,578 | A | 11/1953 | Clendenin |
| 3,503,165 | A | 3/1970 | Hardt |
| 4,290,246 | A | 9/1981 | Hilsey |

(Continued)

FOREIGN PATENT DOCUMENTS

| | | |
|---|---|---|
| CN | 109236031 | 1/2019 |
| FR | 2891567 | 4/2007 |

(Continued)

*Primary Examiner* — Michael P Ferguson
*Assistant Examiner* — Zachary A Hall
(74) *Attorney, Agent, or Firm* — Quisenberry Law PLLC

(57) ABSTRACT

Border walls and related systems and methods are disclosed. A border wall may include a plurality of bollard fence sections adapted for engagement with corresponding base members. Each fence section may include a plurality of bollards. Each base member may include a plurality of openings extending downwardly from a top surface of the base member partially into the base member. The openings in the top of a base member are adapted for engagement with individual corresponding bollards on a bollard fence section. At least one of the bollards is "matched" to a corresponding opening in the base member so that the "matched" bollard, when inserted into and engaged with its corresponding "matched" opening, may function to support and/or align the bollard fence section. The base members may also include connectors, and/or mating alignment notches and protrusions, to facilitate joining and/or leveling of the base members to form a stable wall.

20 Claims, 13 Drawing Sheets

(56) References Cited

U.S. PATENT DOCUMENTS

| | | | | |
|---|---|---|---|---|
| 5,150,885 | A | 9/1992 | Leone | |
| 6,131,350 | A | 10/2000 | Sanders | |
| 7,144,186 | B1 | 12/2006 | Nolte | |
| 9,611,670 | B1 * | 4/2017 | Pacheco | E04H 17/263 |
| 9,863,162 | B2 * | 1/2018 | Whiteley | E04H 17/16 |
| 10,427,916 | B1 | 10/2019 | Fisher | |
| 10,633,887 | B1 | 4/2020 | Fisher | |
| 11,795,726 | B2 * | 10/2023 | Stinson, Sr. | E04H 12/2269 |
| 2004/0156680 | A1 | 8/2004 | Gibbs | |
| 2011/0033232 | A1 * | 2/2011 | Adler | E01F 13/12 404/6 |
| 2016/0222612 | A1 | 8/2016 | Leum | |
| 2018/0347227 | A1 | 12/2018 | Neusch | |
| 2020/0018086 | A1 | 1/2020 | Durrant | |
| 2022/0268054 | A1 * | 8/2022 | Dress | E04H 12/04 |

FOREIGN PATENT DOCUMENTS

| | | | |
|---|---|---|---|
| KR | 100512469 | | 9/2005 |
| KR | 100525989 | | 11/2005 |
| KR | 200419888 | | 6/2006 |
| KR | 100661270 | | 12/2006 |
| KR | 200433073 | Y1 * | 12/2006 |
| KR | 200439583 | | 4/2021 |

* cited by examiner

BORDER WALLS AND RELATED SYSTEMS AND METHODS

RELATED APPLICATIONS

This application is a continuation of U.S. Non-Provisional patent application Ser. No. 16/747,466, filed Jan. 20, 2020, the contents of which are fully incorporated herein by reference in its entirety.

BACKGROUND OF THE INVENTION

1. Field of the Invention

The present inventions generally pertain to wall structures, and more particularly to wall or fence structures for securing a border, including related systems and methods.

2. Description of the Related Art

One of the political issues that has been part of the public discourse in recent years in the United States has related to illegal immigration, and to efforts to secure the border between the United States and Mexico with a border wall. The process of building a border wall along parts of the border has commenced. Currently, border walls are being constructed by pouring concrete foundations in place at the border where the wall is to be constructed. The current process generally entails digging a trench, installing steel rebar reinforcement rods in the trench, filling the trench with concrete, suspending bollard fence sections with the lower portions of the bollards disposed in the concrete, bracing the bollard fence sections to hold them in place until the concrete solidifies, and then removing the bracing. This is a time-consuming, labor-intensive, and costly process.

As will become apparent from the following descriptions and discussion, the present inventions have been developed to provide a means to construct border walls for less money and in less time in comparison to the above-described process of constructing border walls. As will be seen from the below description, use of the present inventions will enable contractors to greatly expedite the rate at which bollard fence walls can be constructed on-site at the border.

SUMMARY OF THE INVENTION

Border walls and related systems and methods are disclosed. In one aspect, a specific embodiment of the present inventions may be a border wall comprising: a plurality of precast concrete base members, each base member including a plurality of left generally circular openings extending downwardly from a top surface of the base member, a square opening extending downwardly from the top surface of the base member, and a plurality of right generally circular openings extending downwardly from the top surface of the base member, the number of left generally circular openings in the base member being less that the number of right generally circular openings in the base member, the square opening being positioned between the plurality of left generally circular openings and the plurality of right generally circular openings, and the diameter of each of the left generally circular openings, right generally circular openings, and the square opening being of approximately the same size; and a plurality of bollard fence sections, each bollard fence section including a plurality of left bollards, a match bollard having a square shape adapted for engagement with the square openings in the base members, and a plurality of right bollards, the match bollard being positioned between the plurality of left bollards and the plurality of right bollards, each of the plurality of left bollards, right bollards, and the match bollard having approximately the same size square cross section, and the number of left bollards corresponding to the number of left openings in the base members and the number of right bollards corresponding to the number of right openings in the base members. Another feature of this aspect of the present inventions may be that there is only one way the bollards will fit into the left, square and right openings, and in this configuration the upper ends of the bollards are connected by a planar sheet that is positioned on a first side of the base members. Another feature of this aspect of the present inventions may be that each base member includes an alignment notch in a first end of the base member and an alignment protrusion in a second end of the base member. Another feature of this aspect of the present inventions may be that each base member includes a first connector at a first end of the base member and a second connector at a second end of the base member, each connector including an aperture. Another feature of this aspect of the present inventions may be that each of the circular openings in the base members is defined by a section of cylindrical tubing, and each of the square openings in the base members is defined by a section of square tubing. Another feature of this aspect of the present inventions may be that each of the circular openings in each base member are aligned with and equidistantly spaced from each other. Another feature of this aspect of the present inventions may be that the circular openings extend downwardly from the top surface of the base member and partially into the base member, each opening has a longitudinal axis, and each longitudinal axis of each opening is generally disposed in parallel relationship to one another.

In another aspect, the present inventions may include a base member comprising: a precast concrete base in the form of a rectangular prism and having a top surface, a front side surface, a back side surface opposite the front side surface, a left end surface, and a right end surface opposite the left end surface; and a plurality of left generally circular openings extending downwardly from the top surface of the base, a square opening extending downwardly from the top surface of the base, and a plurality of right generally circular openings extending downwardly from the top surface of the base, the number of left generally circular openings in the base being less that the number of right generally circular openings in the base, the square opening being positioned between the plurality of left generally circular openings and the plurality of right generally circular openings, and the diameter of each of the left generally circular openings, right generally circular openings, and the square opening being of approximately the same size. Another feature of this aspect of the present inventions may be that each base includes an alignment notch in the first end of the base and an alignment protrusion in the second end of the base. Another feature of this aspect of the present inventions may be that each base includes a first connector at the first end of the base and a second connector at the second end of the base, each connector including an aperture, a first connector on a first base being adapted for engagement with a second connector on a second base. Another feature of this aspect of the present inventions may be that each of the circular openings in the base is defined by a section of cylindrical tubing. Another feature of this aspect of the present inventions may be that the square opening in the base is defined by a section of square tubing. Another feature of this aspect of the present inventions may be that each of the circular openings in the base are aligned with and equidistantly spaced from each other. Another feature of this aspect of the present inventions may be that the circular openings extend downwardly from the top surface of the base and partially into the base, each opening has a longitudinal axis, and each longitudinal axis of each opening is generally disposed in parallel relationship to one another.

In another aspect, the present inventions may include a bollard fence section adapted for engagement with a base member, the base member including a plurality of left generally circular openings extending downwardly from a top surface of the base member, a square opening extending downwardly from the top surface of the base member, and a plurality of right generally circular openings extending downwardly from the top surface of the base member, the number of left generally circular openings in the base member being less that the number of right generally circular openings in the base member, and the square opening being positioned between the plurality of left generally circular openings and the plurality of right generally circular openings, the bollard fence section comprising: a plurality of left bollards, a match bollard having a square shape adapted for engagement with the square opening in the base member, and a plurality of right bollards, the match bollard being positioned between the plurality of left bollards and the plurality of right bollards, each of the plurality of left bollards, right bollards, and the match bollard having approximately the same size square cross section, and the number of left bollards corresponding to the number of left openings in the base member and the number of right bollards corresponding to the number of right openings in the base member. Another feature of this aspect of the present inventions may be that there is only one way the bollards will fit into the left, square and right openings in the base member, and in this configuration the upper ends of the bollards are connected by a planar sheet that is positioned on a first side of the base member. Another feature of this aspect of the present inventions may be that the base member includes an alignment notch in the first end of the base member and an alignment protrusion in the second end of the base member. Another feature of this aspect of the present inventions may be that the base member includes a first connector at the first end of the base member and a second connector at the second end of the base member, each connector including an aperture. Another feature of this aspect of the present inventions may be that each of the circular openings in the base member is defined by a section of cylindrical tubing, the square opening in the base member is defined by a section of square tubing, and each of the circular openings in the base member are aligned with and equidistantly spaced from each other. Another feature of this aspect of the present inventions may be that the circular openings extend downwardly from the top surface of the base member and partially into the base member, each opening has a longitudinal axis, and each longitudinal axis of each opening is generally disposed in parallel relationship to one another.

Other features, aspects and advantages of the present inventions will become apparent from the following discussion and detailed description.

While the present inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the various inventions as defined by the appended claims.

DETAILED DESCRIPTION OF THE INVENTION

Figure 1:
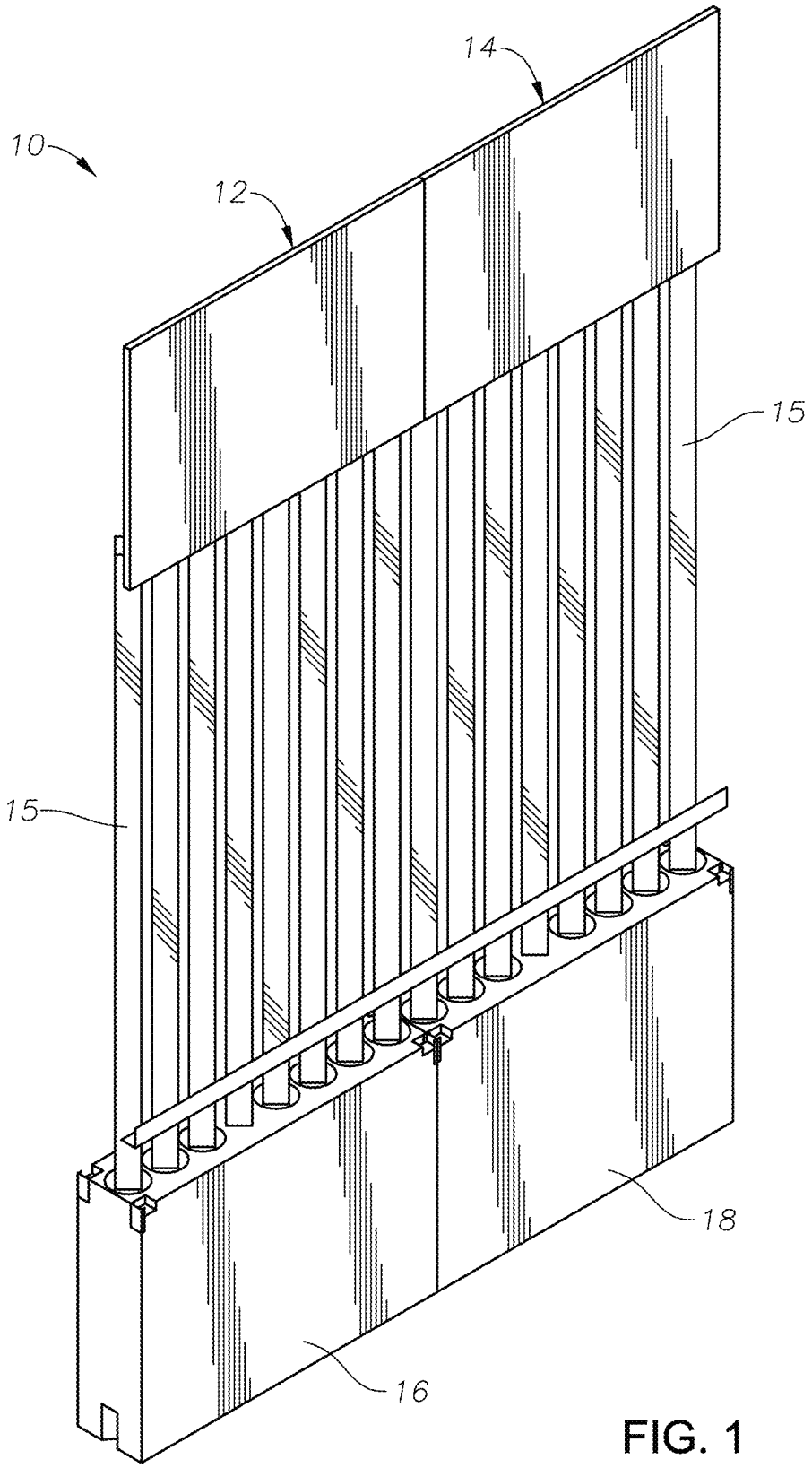
FIG. 1 is a perspective view showing a section of border wall including first and second bollard sections engaged with first and second base members, respectively.
Figure 2:
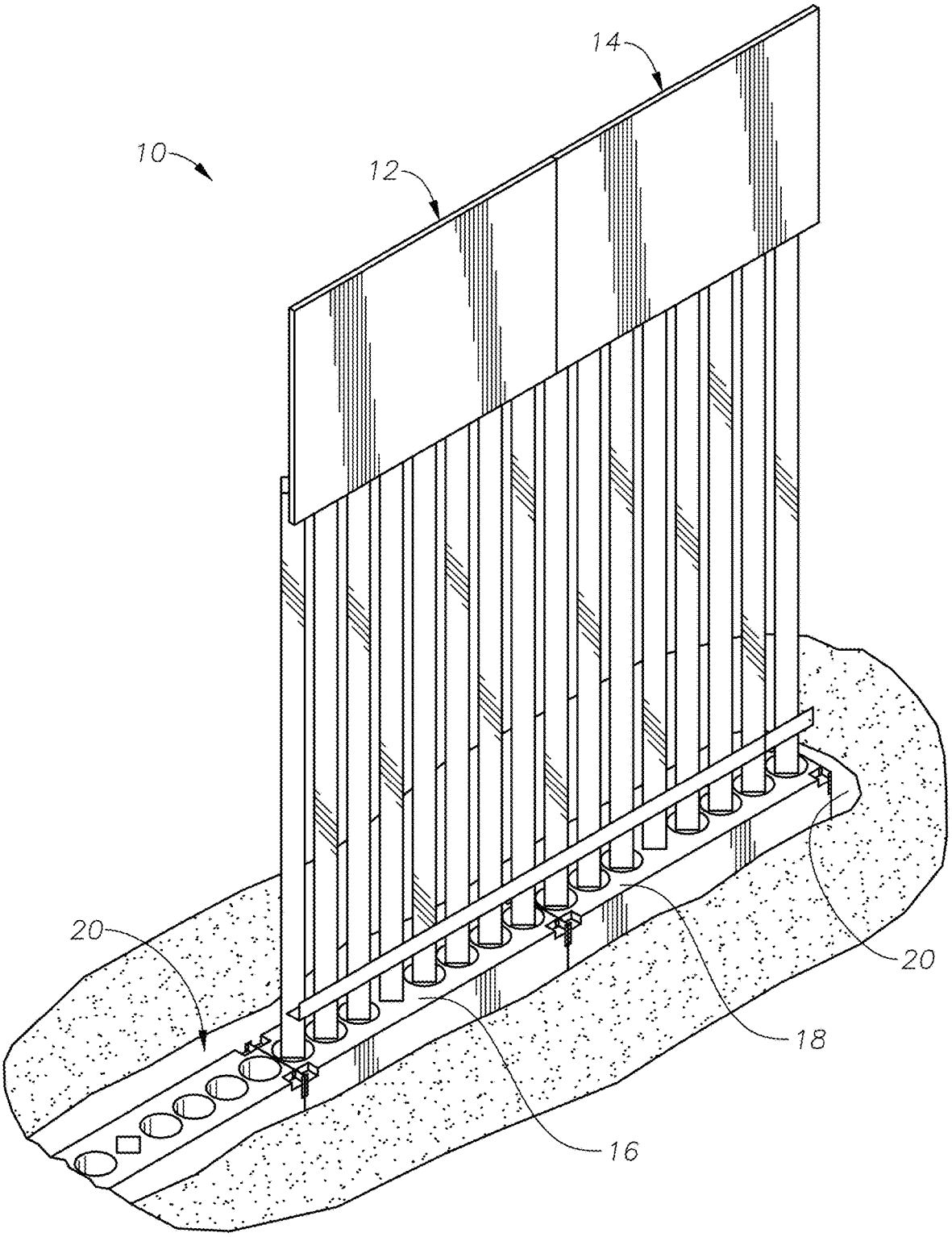
FIG. 2 is another perspective view similar to FIG. 2 but showing the base members positioned in a trench.

Referring to the drawings in detail, wherein like numerals denote identical elements throughout the several views, there is shown in FIG. 1 a perspective view of a section of border wall 10 including first and second bollard sections 12 and 14 engaged with first and second base members 16 and 18, respectively. In a specific embodiment, the base members 16/18 are preferably precast with concrete at a facility remote from the border, and then delivered to the border for installation, as further discussed below. Each bollard section 12/14 includes a plurality of bollards 15. In a specific embodiment, the bollards 15 may have a square cross section and be made from square metal tubing; the bollards 15 may also be situated at a 45 degree angle relative to a front plane of the bollard sections 12/14. FIG. 2 is a perspective view showing a section of border wall 10 similar to FIG. 1, but showing the base members 16 and 18 positioned in a trench 20.

Figure 3:
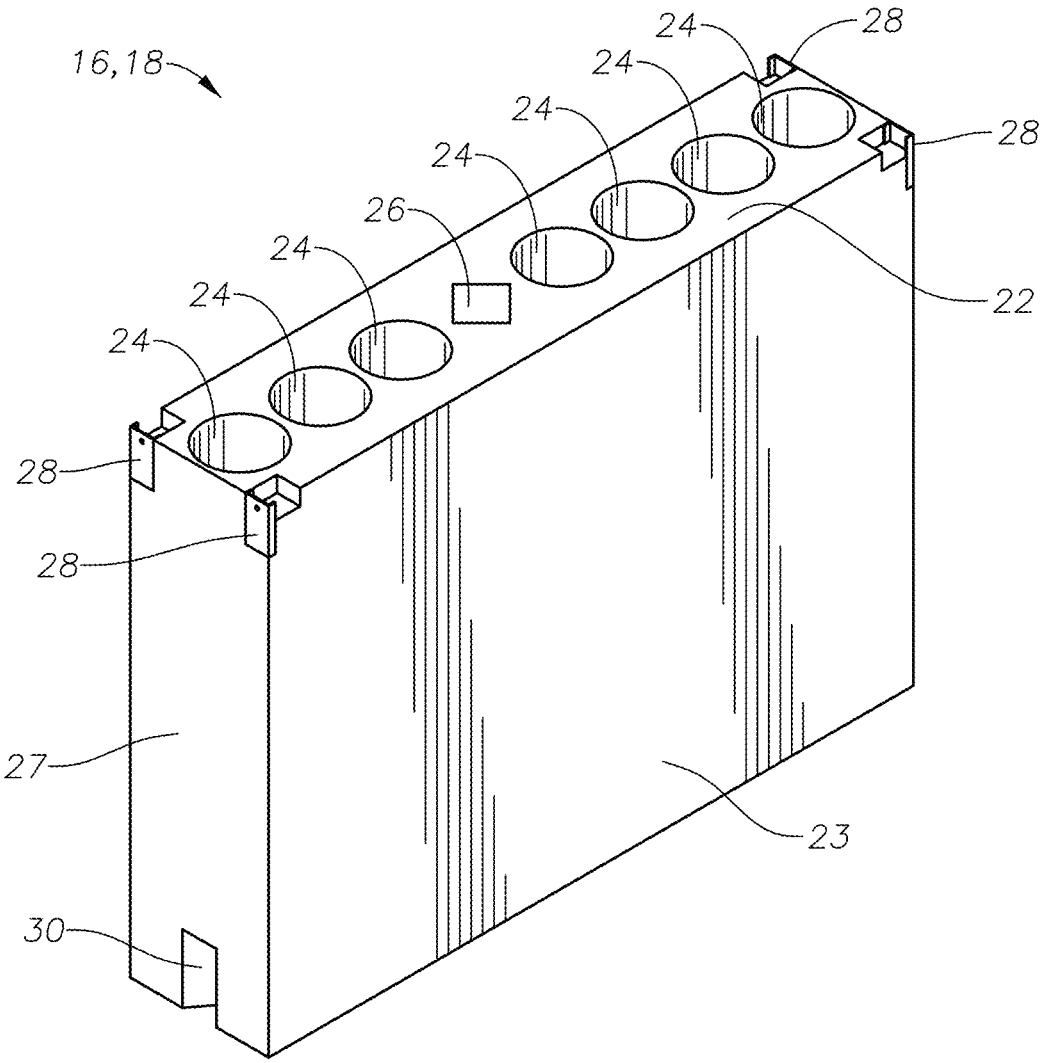
FIG. 3 is a perspective view of a base member constructed in accordance with a specific embodiment of the present inventions.

Referring now to FIG. 3, a perspective view of a base member 16/18 is shown. In a specific embodiment, the base members 16/18 may be in the form of a rectangular prism, and may be precast from concrete. Each base member 16/18 may include a top surface 22, a front side surface 23, a back side surface 25 opposite the front side surface 23, a left end surface 27, and a right end surface 31 opposite the left end surface 27. In a specific embodiment, each base member 16/18 may be about six feet high, about one foot ten inches wide, and about eight feet long. Each base member 16/18 includes a plurality of openings that partially extend downwardly into the base member 16/18 from the top surface 22 of the base member 16/18. The number of openings will correspond to the number of bollards 15 in the bollard fence sections 12/14. The openings are spaced apart corresponding to the spacing of the bollards 15 on the bollard fence sections 12/14. The openings are further illustrated in FIG. 4, which is an end view of a base member 16/18, and in FIG. 5, which is a top view of a base member 16/18. In a specific embodiment, each base member 16/18 may include seven circular or cylindrical openings 24 and one square opening 26. In a specific embodiment, the depth of each opening 24/26 may be about two and one half feet. In a specific embodiment, the circular openings 24 may be formed or defined by a pipe or other cylindrical conduit that is precast in place in the base members 16/18 during the manufacturing process. In a specific embodiment, each opening 24/26 may have a longitudinal axis, and each longitudinal axis of each opening 24/26 may be generally disposed in parallel relationship to one another. In a specific embodiment, the openings 24/26 may be disposed in aligned relationship and equidistant from each other.

In a specific embodiment, the square opening 26 may be formed or defined by a section of square tubing or similar structure that is precast in place in the base members 16/18 during when the base members 16/18 are being manufactured. In a specific embodiment, the square opening 26 may be preferably positioned generally in a central portion of the base member 16/18 and between the circular openings 24. The size of the square opening 26 is designed so as to closely or snuggly receive, or "match," one of the bollards 15 on a bollard section 12/14. In a specific embodiment, the interior dimensions of the square opening 26 may be designed to provide for a clearance between each side of its matching bollard 15 and each corresponding side of the square opening 26 in the range of 1/16 to 1/8 inches. In a specific embodiment, the square opening 26 may be positioned on the diagonal or at a 45 degree angle relative to the longer sides of the base members 16/18 so as to matingly engage with its matching bollard 15. This can be accomplished by precasting a bollard matching section (e.g., a length of square tubing) in the square opening 26 to match the matching bollard 15 in the bollard sections 12/14. The mating engagement of the matching bollard 15 with the square opening 26 allows the square opening 26 to support the bollard fence section 12/14 without the need for bracing, such as that required with the current border wall manufacturing method described above.

Figure 7:
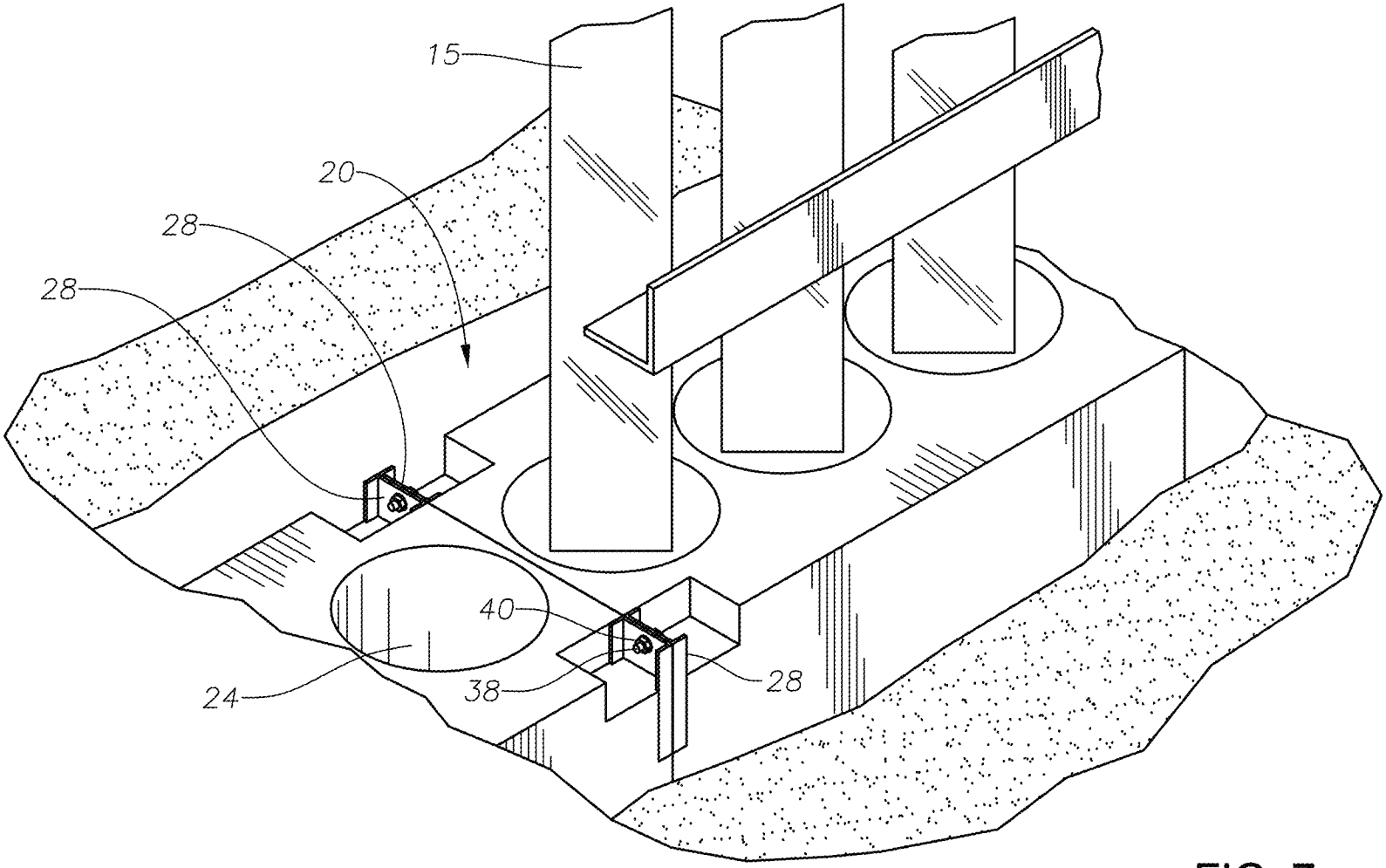
FIG. 7 is a perspective view showing two base members connected end-to-end in a trench.
Figure 8:
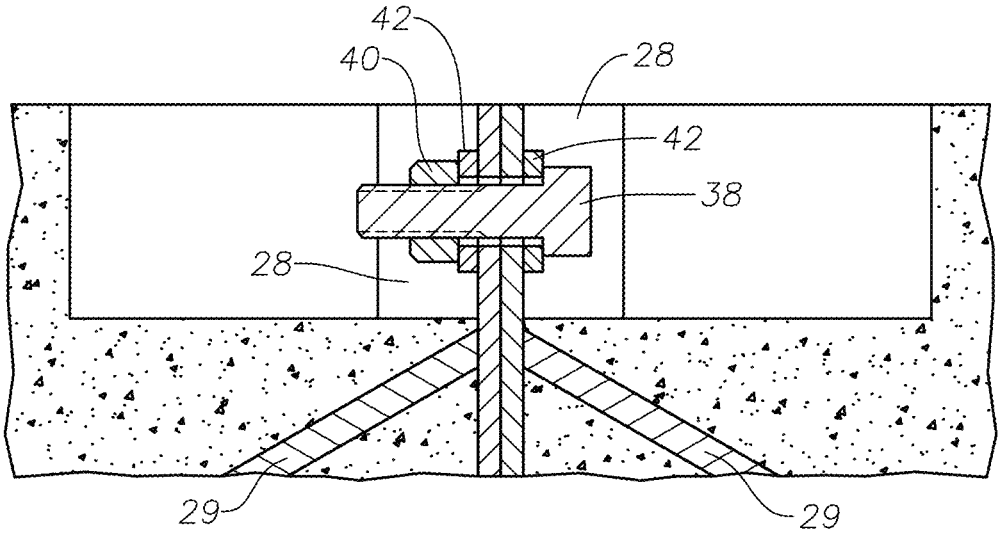
FIG. 8 is an exploded cross-sectional view showing the manner in which connectors on adjacent base members may be connected in a conventional manner using a bolt, nut and washers.

With reference to FIG. 3, in a specific embodiment, the upper corners of each base member 16/18 may be provided with connectors 28. In a specific embodiment, each connector 28 may be a section of steel "C" channel that is embedded and anchored into the base member 16/18 during the precasting process. (See anchors 29 in FIG. 8, discussed further below). In a specific embodiment, each connector 28 is provided with an aperture to receive a bolt 38 as further explained below. The connectors 28 function to attach the base members 16/18 to each other during installation in a trench 20 at the border, as will be further explained below. This is further depicted, for example, in FIG. 7, which is a perspective view showing two base members 16/18 placed end to end in a trench 20, with the connectors 28 aligned and secured to one another. The manner in which the connectors 28 may be aligned with and connected to each other in a conventional manner with a bolt 38, nut 40 and washers 42 is shown in FIG. 8.

Figure 4:
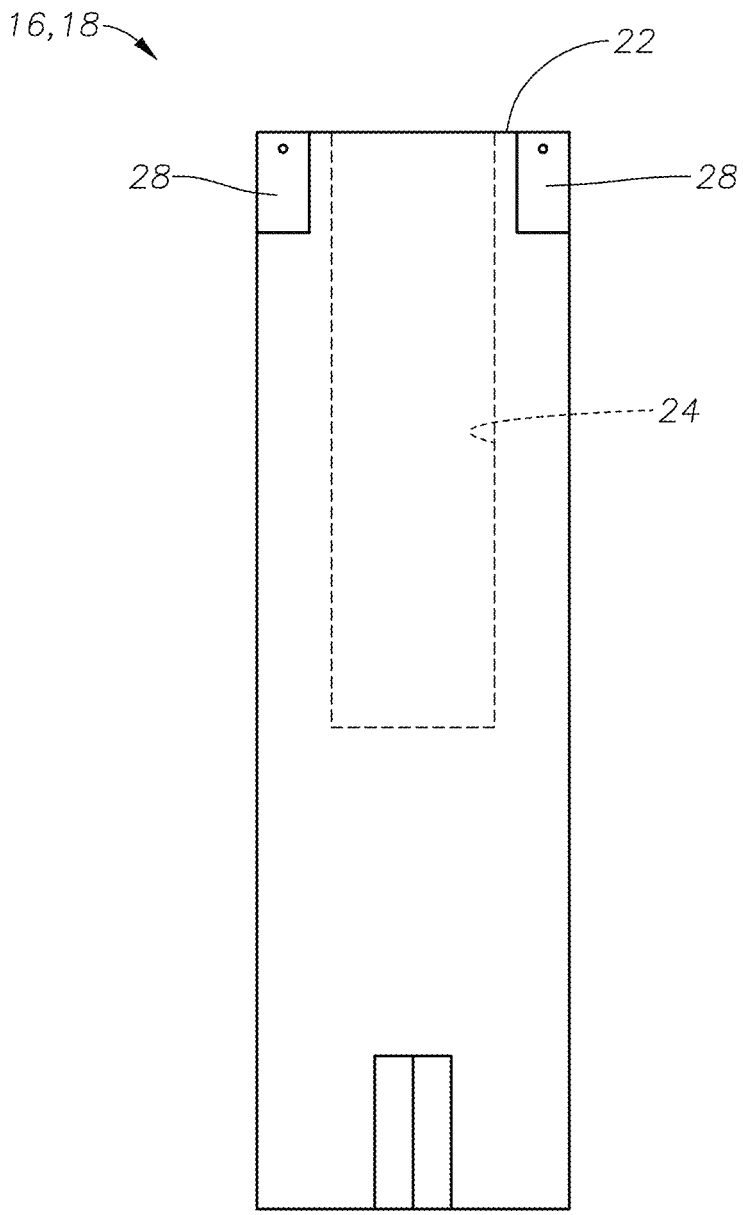
FIG. 4 is an end view of the base member shown in FIG. 3.
Figure 5:
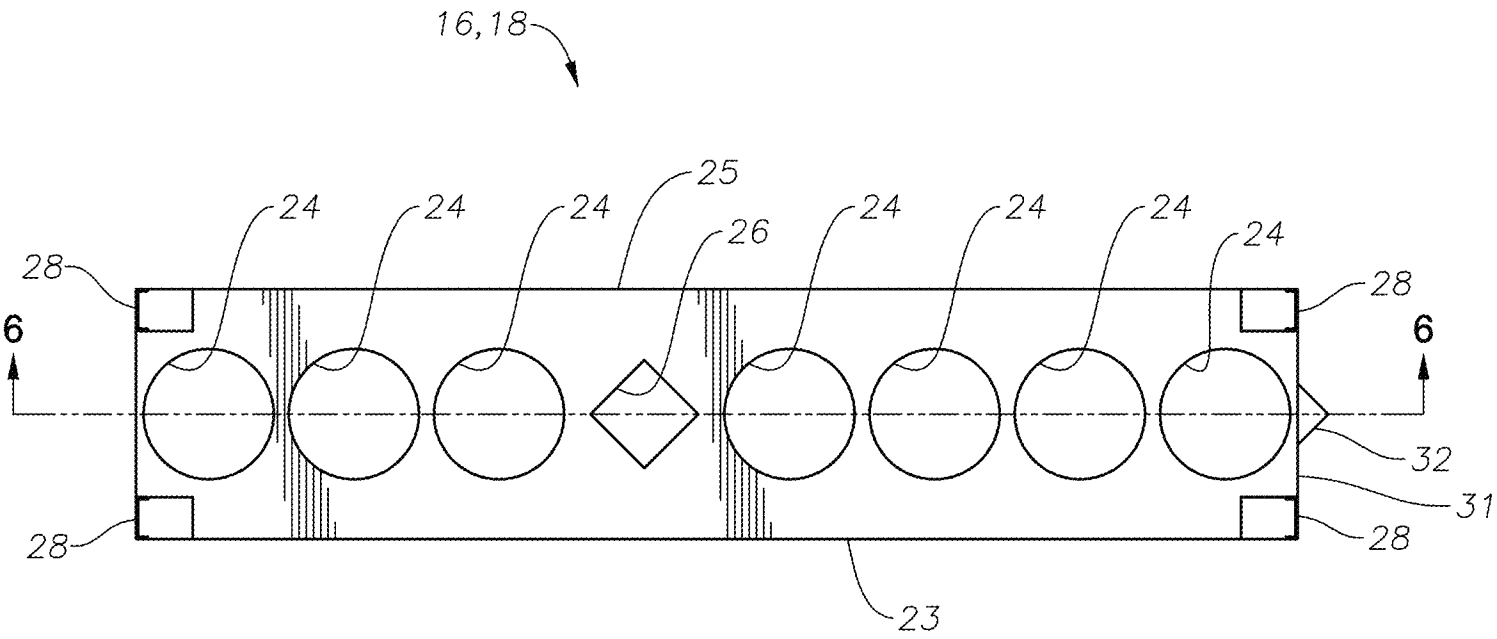
FIG. 5 is a top view of the base member shown in FIG. 3.
Figure 6:
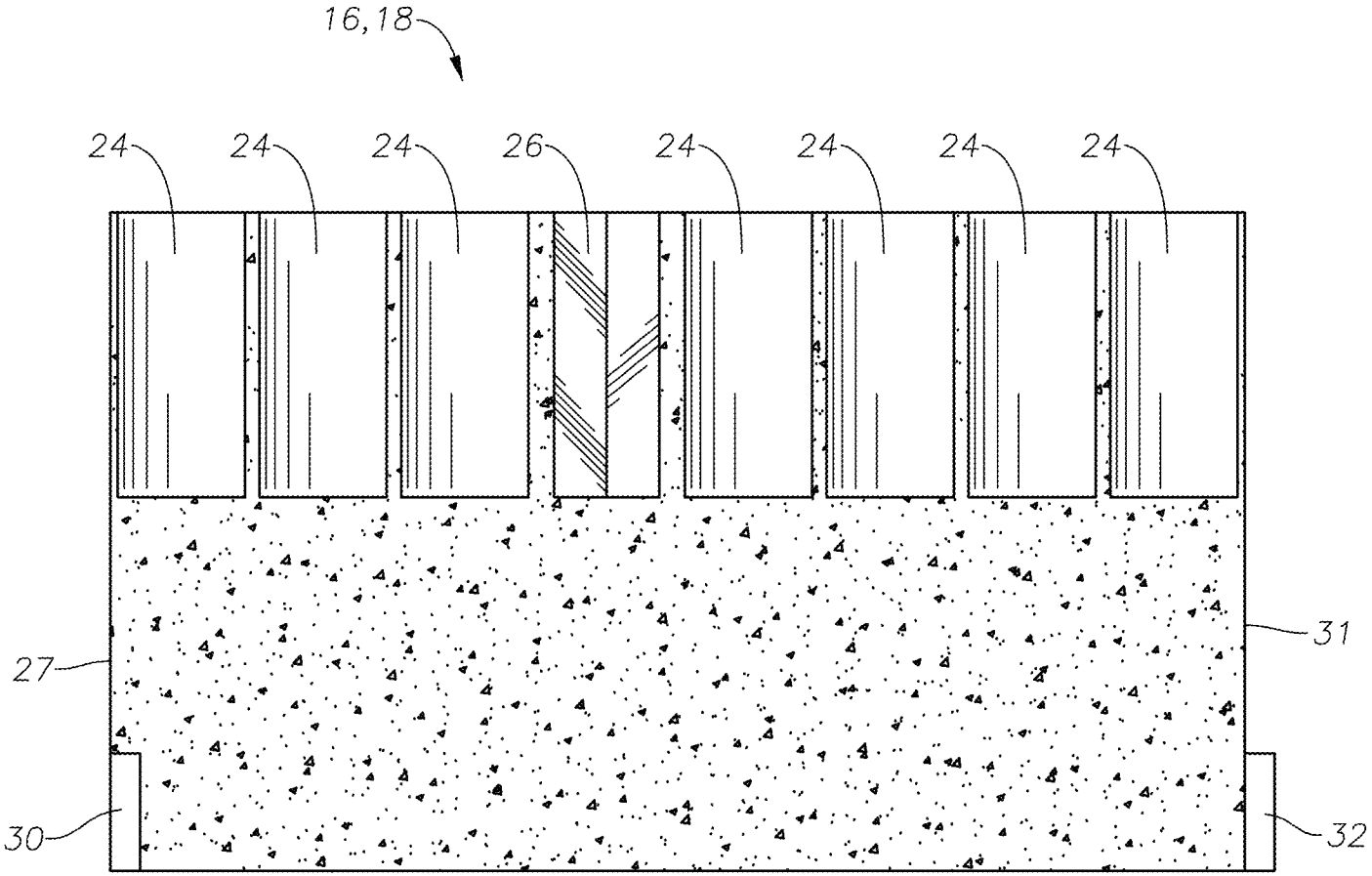
FIG. 6 is a side view of the base member shown in FIG. 5 taken along line 6-6 in FIG. 5.

With reference to FIGS. 3, 4 and 6, the base members 14/16 may be provided with the ability to engage and align the bottom portions of the base members 14/16 in end-to-end relationship. In a specific embodiment, as shown in FIG. 3, each base member 16/18 may be provided with an alignment notch or recess 30, which may be centrally located at the bottom of an end of the base member 16/18. In a specific embodiment, the notch/recess 30 may be in the shape of a triangular prism. In a specific embodiment, as shown in FIG. 6, an opposite end of the base member 16/18 may include an alignment protrusion 32, which may be centrally located at the bottom of said opposite end of the base member 16/18. In a specific embodiment, the protrusion 32 may be formed from a section of angle iron adapted for engagement with a notch/recess 30 in the shape of a triangular prism. The alignment notch/recess 30 and alignment protrusion 32 are designed for mating engagement. When the base members 16/18 are installed in a trench 20 at the border in end-to-end relationship, they are abutted adjacent one another with an alignment protrusion 32 on one base member 16/18 engaged with the alignment notch/recess 30 on its adjacent base member 16/18. In this manner, the alignment protrusions 32 and alignment notches/recesses 30 may function to assist in maintaining adjacent base members 16/18 in alignment with one another, and so as to assist them in functioning as a joined unit.

Figure 9:
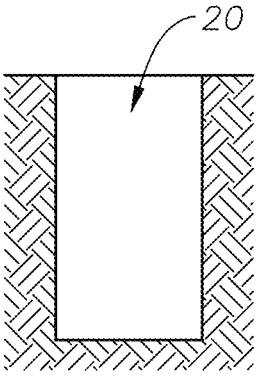
FIG. 9 is an elevation view showing a trench that has been excavated and in which precast concrete base members may be installed for supporting bollard wall sections to construct a border wall.
Figure 10:
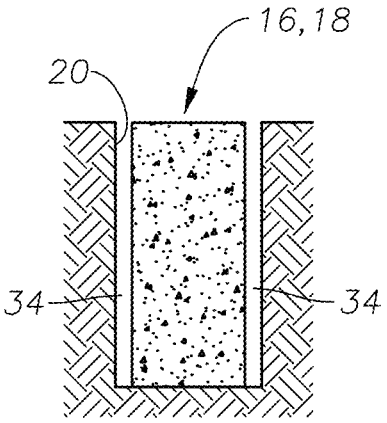
FIG. 10 is an elevation view showing a base member positioned in the trench as shown in FIG. 9.
Figure 11:
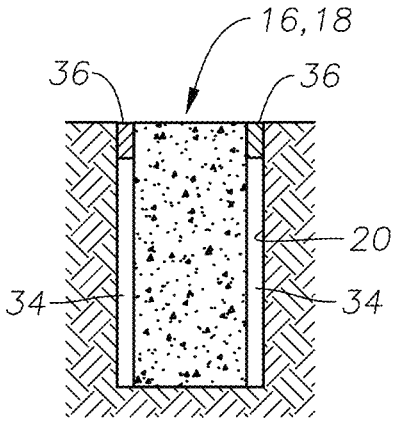
FIG. 11 is another elevation view similar to FIG. 10 but further showing shims in use to horizontally level a base member in the trench.
Figure 12:
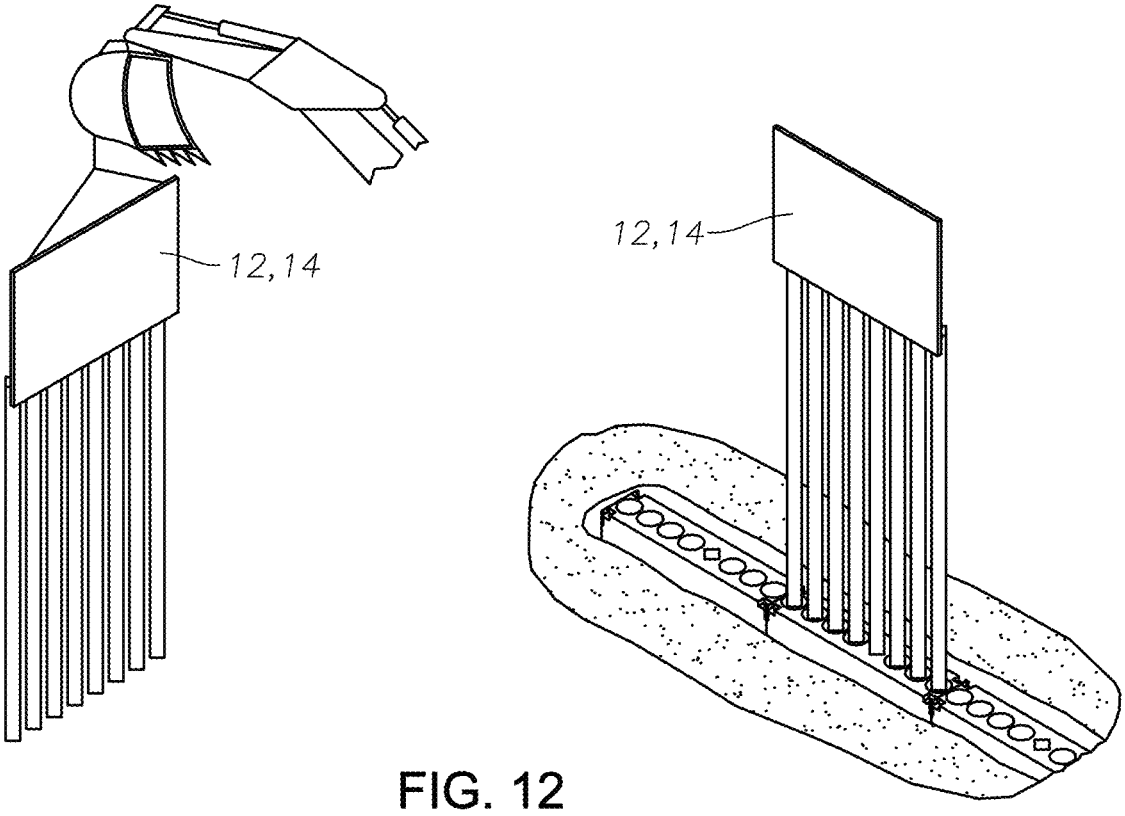
FIG. 12 shows a machine in the process of lifting a bollard fence section to move it into position for engagement with a precast concrete base section.
Figure 13:
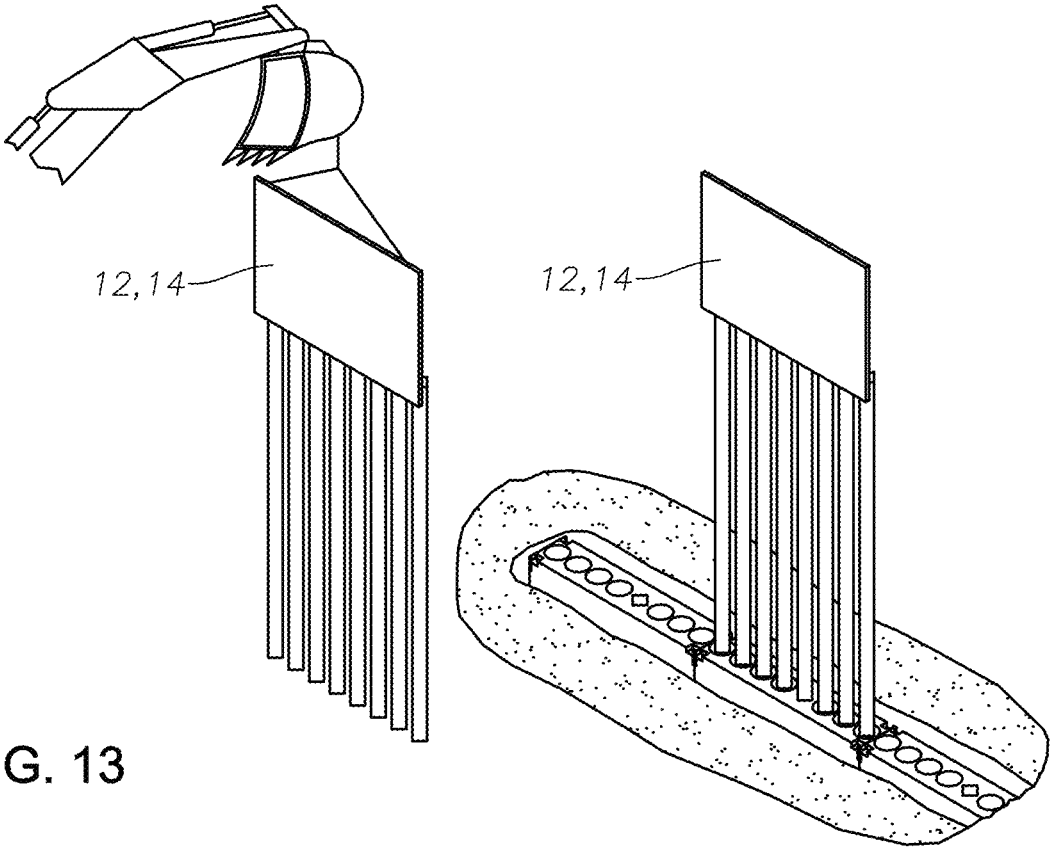
FIG. 13 shows the machine moving the bollard fence section toward a precast concrete base section for engagement therewith.
Figure 14:
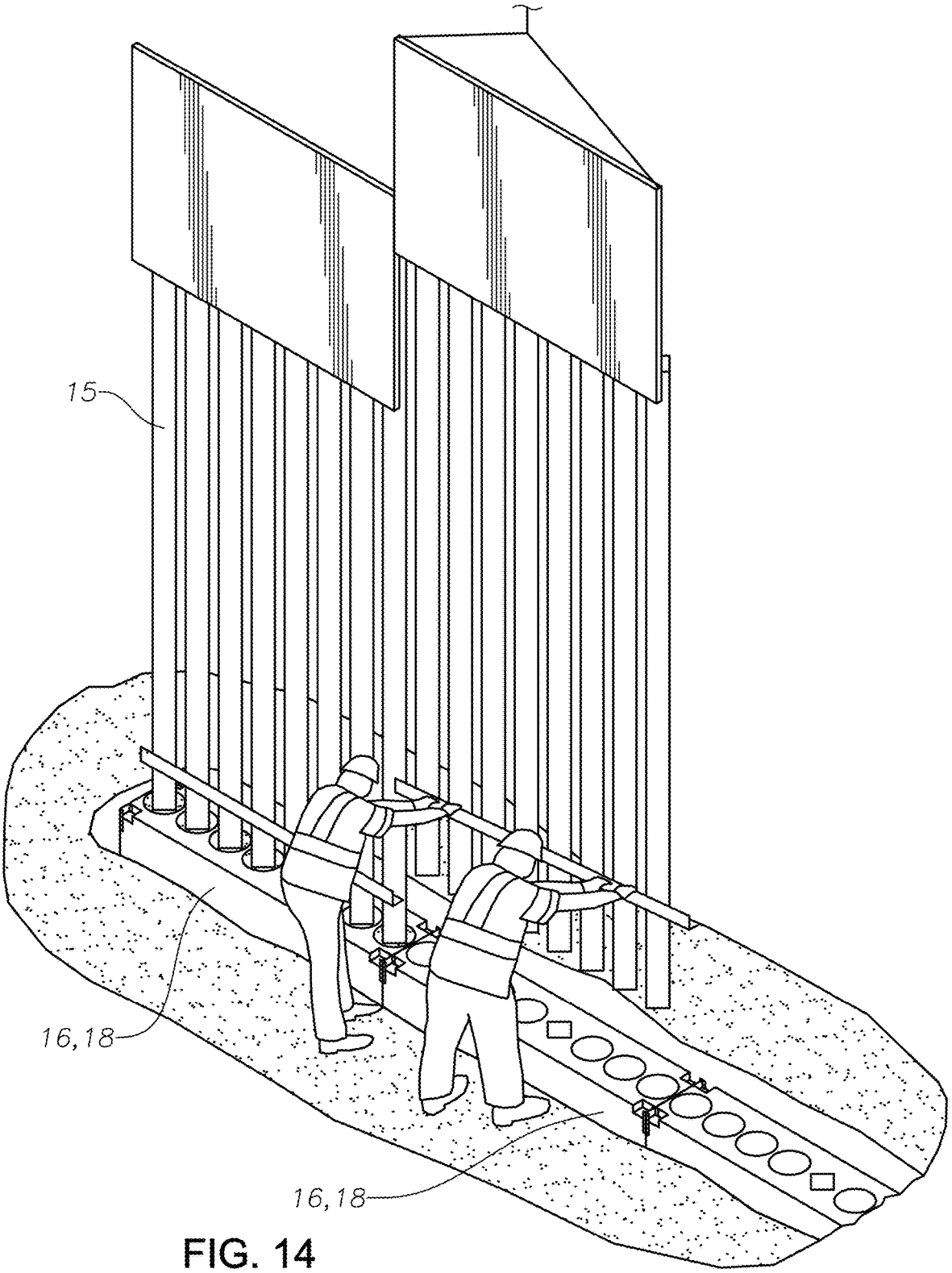
FIG. 14 shows workers guiding the bollard fence section as it is being lowered toward the precast concrete base section, and aligning the individual bollards with their corresponding openings in the top of the precast concrete base section.
Figure 15:
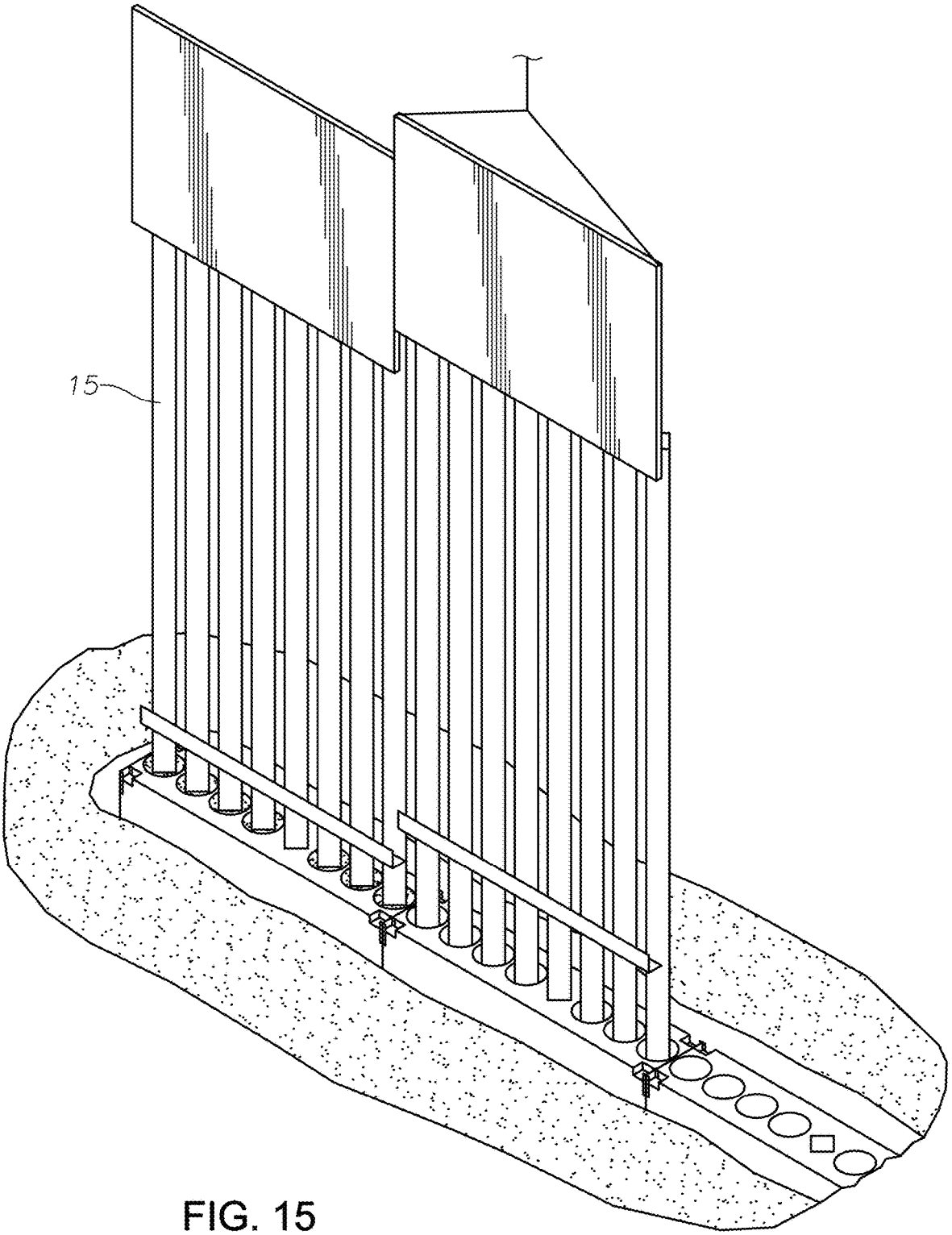
FIG. 15 is another view similar to FIG. 14, but showing the individual bollards partially inserted into their corresponding openings in the top of the precast concrete base section.

As mentioned above, the base members 16/18 are preferably precast using concrete at a facility remote from the border, and then delivered to the border for installation. The installation process at the border begins by excavating a trench 20, as shown for example in FIG. 9. In a specific embodiment, the trench 20 may be approximately six feet deep and approximately two feet wide. Next, as shown for example in FIGS. 2 and 10, the precast base members 16/18 are positioned in the trench 20 in end-to-end abutting relationship. The base members 16/18 are leveled horizontally and vertically. Alignment notches and protrusions 30/32 on adjacent base members 16/18 are engaged, and corresponding connectors 28 are secured to one another, to secure adjacent base members 16/18 to one another. Bolting the corresponding connectors 28 to one another will maintain top of unit elevation and provide more stability for the base members 16/18. As shown in FIG. 11, shims 36 (such as made from wood) may be positioned near the top of the trench 20 in void spaces 34 between the base members 16/18 and the sides of the trench 20 to assist in horizontally leveling the base members 16/18. The void spaces 34 are then preferably filled with flowable fill such as concrete.

Figure 16:
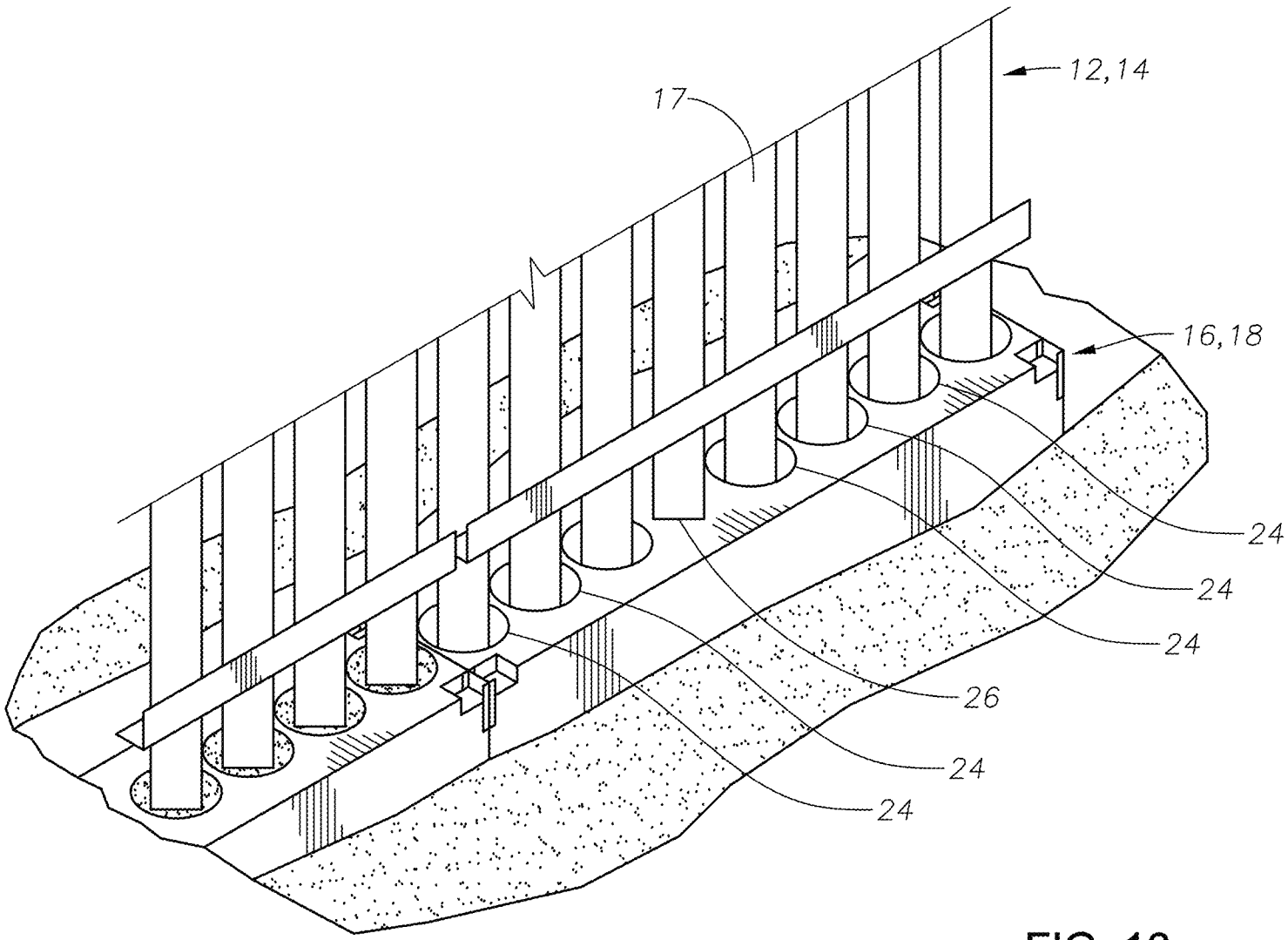
FIG. 16 is a perspective view showing the individual bollards fully inserted into their corresponding openings in the top of the precast concrete base section.

Next, as shown for example in FIGS. 12-15, individual bollard section 12/14 are moved into position over a precast concrete base member 16/18, then lowered toward the base member 16/18, and the individual bollards 15 are guided and inserted into the openings 24/26 in the base members 16/18. Referring to FIG. 16, the individual bollards 15 on a bollard section 12/14 are shown inserted into their respective corresponding openings 24/26 in the base member 16/18. More specifically, a matching bollard 17 is inserted in the match cast square opening 26. In a specific embodiment, the engagement of the matching bollard 17 with the match cast square opening 26 functions to support the entire bollard section 12/14 (without the need for bracing), and position it in proper alignment in relation to its adjacent bollard sections 12/14, as shown for example in FIGS. 1 and 2.

Figure 17:
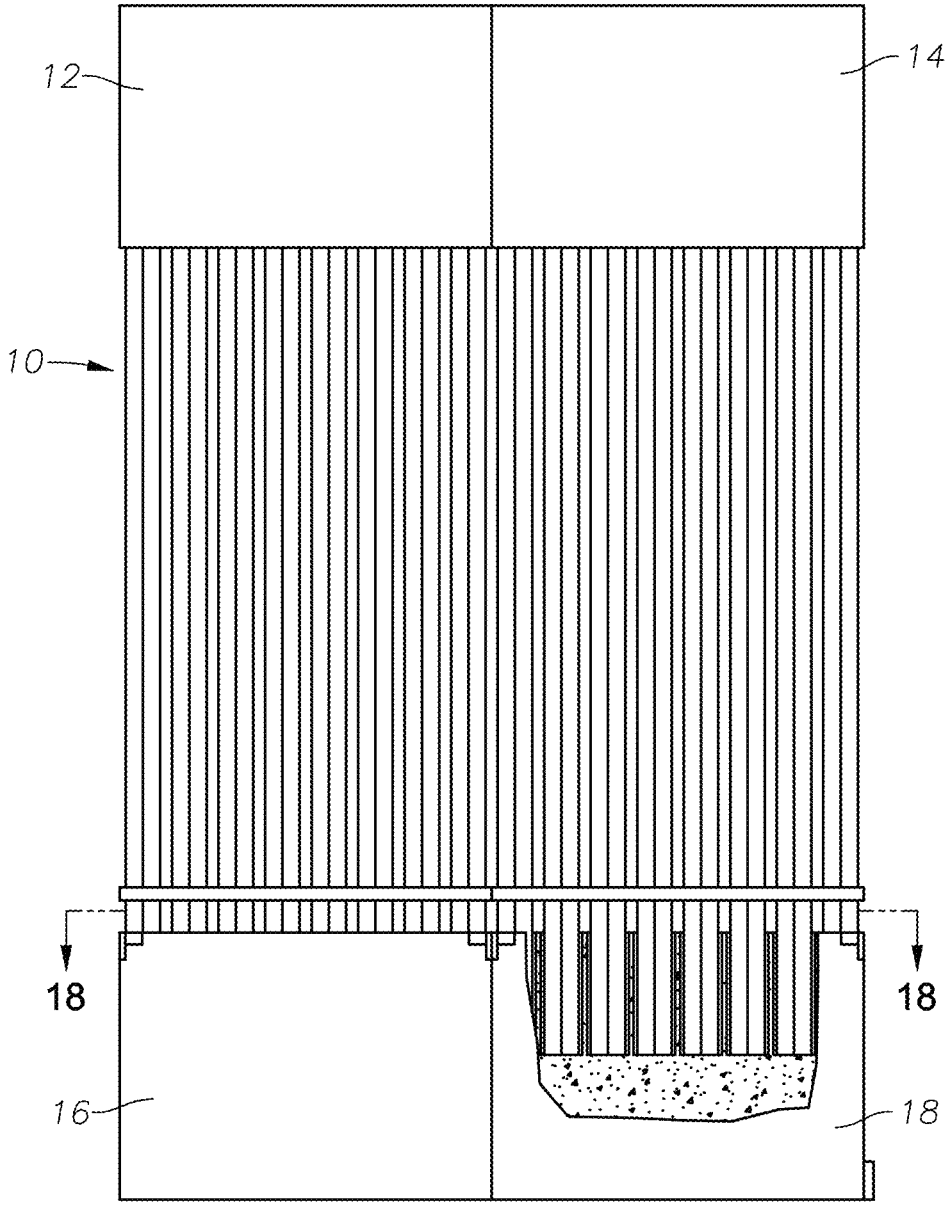
FIG. 17 is an elevation view showing the front of a border wall after it has been installed.
Figure 19:
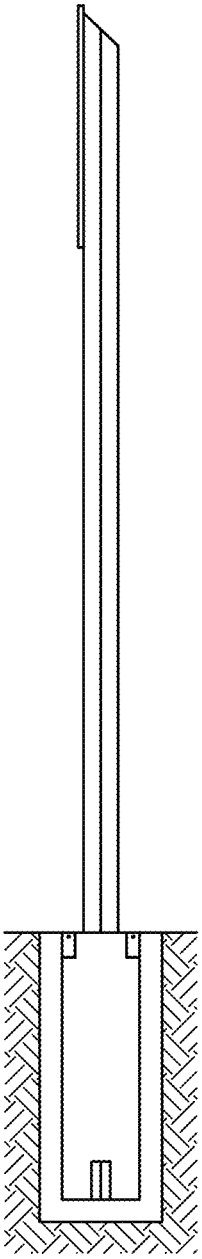
FIG. 19 is a side elevation view of the installed border wall as shown in FIG. 17.
Figure 18:
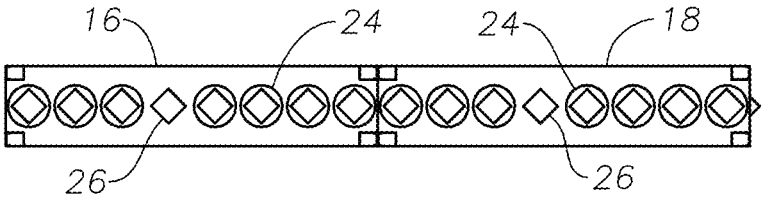
FIG. 18 is a top cross-sectional view taken along lines 18-18 of FIG. 17.

While the matching bollard 17 snuggly fits into the matching square opening 26, the other individual bollards 15 fit in the circular openings 24 with open space between each bollard 15 and the side walls of its corresponding circular opening 24. After a bollard section 12/14 is put into place as shown in FIG. 16, fillable flow such as grout or concrete may then be poured in to the circular openings 24 to fill in the space between the bollard 15 and the sides of its corresponding circular opening 24. FIGS. 17-19 illustrate two bollard sections 12/14 installed on and being supported by two base members 16/18 to form a wall 10. Once installed the bollards 15 are supported in a vertical position by the base members 16/18, and a longitudinal axis of each opening 24/26 is likewise disposed in a vertical position.

In light of the above and foregoing description, it can be seen that the present inventions provide advantages and benefits in comparison to the current method of constructing border walls as described above in the "Description of Related Art." As discussed and shown above, by manufacturing the precast concrete base sections at a location remote from the border, the present inventions enable construction of bollard walls at a much faster rate in comparison to the construction method in current use. With the present inventions, the precast concrete base sections can be quickly positioned in the trench one after another in end-to-end abutting relationship, and connected to one another to form a cohesive and stable foundation to support the bollard fence sections. After the precast concrete base sections are installed in the trench, the individual bollard fence sections can be inserted into the openings on top of the base sections. As explained above, one of the bollards in each fence section is "matched" to one of the openings in the top of a base section. Engagement of that "matched" bollard with its "matched" opening in the base section supports the entire bollard fence section. Filling in the spaces around the other bollards and their corresponding circular openings with grout, concrete or other fillable material adds additional support and stability to wall.

Unlike the current border-wall construction method as discussed above, border walls constructing in accordance with the present invention do not require any bracing of the bollard fence sections until concrete is allowed to set. This reduces construction time, and saves money in reduced material and labor costs. Similarly, unlike the current construction method, use of the present inventions do not require installing rebar in the trench, pouring concrete foundations, using expensive heavy machinery to suspend the bollard fence sections in place with the lower ends of the individual bollards positioned in the concrete (including at just the right depth and with the bollard fence section leveled), and then, as already mentioned, bracing the fence sections to hold them in place while the concrete sets. Thus, it can be seen that the additional expense and construction time of the current construction method is avoided through use of the present inventions.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims.

The invention claimed is:

1. A border wall comprising:

a plurality of precast concrete base members, each base member including a plurality of left generally circular openings extending downwardly from a top surface of the base member, a square opening extending downwardly from the top surface of the base member, and a plurality of right generally circular openings extending downwardly from the top surface of the base member, the number of left generally circular openings in the base member being less that the number of right generally circular openings in the base member, the square opening being positioned between the plurality of left generally circular openings and the plurality of right generally circular openings, and the diameter of each of the left generally circular openings, right generally circular openings, and the square opening being of approximately the same size; and a plurality of bollard fence sections, each bollard fence section including a plurality of left bollards, a match bollard having a square shape adapted for engagement with the square openings in the base members, and a plurality of right bollards, the match bollard being positioned between the plurality of left bollards and the plurality of right bollards, each of the plurality of left bollards, right bollards, and the match bollard having approximately the same size square cross section, the number of left bollards corresponding to the number of left openings in the base members and the number of right bollards corresponding to the number of right openings in the base members, the plurality of left bollards being adapted for positioning in the left generally circular openings, and the plurality of right bollards being adapted for positioning in the right generally circular openings.

2. The border wall of claim 1, wherein there is only one way the bollards will fit into the left, square and right openings, and in this configuration the upper ends of the bollards are connected by a planar sheet that is positioned on a first side of the base members.

3. The border wall of claim 1, wherein each base member includes an alignment notch in a first end of the base member and an alignment protrusion in a second end of the base member.

4. The border wall of claim 1, wherein each base member includes a first connector at a first end of the base member and a second connector at a second end of the base member, each connector including an aperture.

5. The border wall of claim 1, wherein each of the circular openings in the base members is defined by a section of cylindrical tubing, and each of the square openings in the base members is defined by a section of square tubing.

6. The border wall of claim 1, wherein each of the circular openings in each base member are aligned with and equidistantly spaced from each other.

7. The border wall of claim 1, wherein the circular openings extend downwardly from the top surface of the base member and partially into the base member, each opening has a longitudinal axis, and each longitudinal axis of each opening is generally disposed in parallel relationship to one another.

8. A base member adapted for engagement with a bollard section, the bollard fence section including a plurality of left bollards, a match bollard having a square shape, and a plurality of right bollards, the match bollard being positioned between the plurality of left bollards and the plurality of right bollards, the plurality of left bollards, right bollards, and the match bollard having approximately the same size square cross section, the base member comprising:

a precast concrete base in the form of a rectangular prism and having a top surface, a front side surface, a back side surface opposite the front side surface, a left end surface, and a right end surface opposite the left end surface; and a plurality of left generally circular openings extending downwardly from the top surface of the base, a square opening extending downwardly from the top surface of the base, and a plurality of right generally circular openings extending downwardly from the top surface of the base, the number of left generally circular openings in the base being less that the number of right generally circular openings in the base, the square opening being positioned between the plurality of left generally circular openings and the plurality of right generally circular openings, and the diameter of each of the left generally circular openings, right generally circular openings, and the square opening being of approximately the same size, the match bollard being adapted for engagement with the square opening in the base member, the number of left bollards corresponding to the number of left generally circular openings in the base member and the number of right bollards corresponding to the number of right generally circular openings in the base member, the plurality of left bollards being adapted for positioning in the left generally circular openings, and the plurality of right bollards being adapted for positioning in the right generally circular openings.

9. The base member of claim 8, wherein each base includes an alignment notch in the first end of the base and an alignment protrusion in the second end of the base.

10. The base member of claim 8, wherein each base includes a first connector at the first end of the base and a second connector at the second end of the base, each connector including an aperture, a first connector on a first base being adapted for engagement with a second connector on a second base.

11. The base member of claim 8, wherein each of the circular openings in the base is defined by a section of cylindrical tubing.

12. The base member of claim 8, wherein the square opening in the base is defined by a section of square tubing.

13. The base member of claim 8, wherein each of the circular openings in the base are aligned with and equidistantly spaced from each other.

14. The base member of claim 8, wherein the circular openings extend downwardly from the top surface of the base and partially into the base, each opening has a longitudinal axis, and each longitudinal axis of each opening is generally disposed in parallel relationship to one another.

15. A bollard fence section adapted for engagement with a base member, the base member including a plurality of left generally circular openings extending downwardly from a top surface of the base member, a square opening extending downwardly from the top surface of the base member, and a plurality of right generally circular openings extending downwardly from the top surface of the base member, the number of left generally circular openings in the base member being less that the number of right generally circular openings in the base member, and the square opening being positioned between the plurality of left generally circular openings and the plurality of right generally circular openings, the bollard fence section comprising:

a plurality of left bollards, a match bollard having a square shape adapted for engagement with the square opening in the base member, and a plurality of right bollards, the match bollard being positioned between the plurality of left bollards and the plurality of right bollards, each of the plurality of left bollards, right bollards, and the match bollard having approximately the same size square cross section, the number of left bollards corresponding to the number of left openings in the base member and the number of right bollards corresponding to the number of right openings in the base member, the plurality of left bollards being adapted for positioning in the left generally circular openings, and the plurality of right bollards being adapted for positioning in the right generally circular openings.

16. The bollard fence section of claim 15, wherein there is only one way the bollards will fit into the left, square and right openings in the base member, and in this configuration the upper ends of the bollards are connected by a planar sheet that is positioned on a first side of the base member.

17. The bollard fence section of claim 15, wherein the base member includes an alignment notch in the first end of the base member and an alignment protrusion in the second end of the base member.

18. The bollard fence section of claim 15, wherein the base member includes a first connector at the first end of the base member and a second connector at the second end of the base member, each connector including an aperture.

19. The bollard fence section of claim 15, wherein each of the circular openings in the base member is defined by a section of cylindrical tubing, the square opening in the base member is defined by a section of square tubing, and each of the circular openings in the base member are aligned with and equidistantly spaced from each other.

20. The bollard fence section of claim 15, wherein the circular openings extend downwardly from the top surface of the base member and partially into the base member, each opening has a longitudinal axis, and each longitudinal axis of each opening is generally disposed in parallel relationship to one another.

* * * * *